US007874849B2

(12) United States Patent
Sticker et al.

(10) Patent No.: US 7,874,849 B2
(45) Date of Patent: Jan. 25, 2011

(54) PLUG FOR SHIELDED DATA CABLES

(75) Inventors: Rolf Sticker, Donaueschingen (DE); Werner Rösch, Blumberg (DE)

(73) Assignee: MC Technology GmbH, Blumberg (DE)

( * ) Notice: Subject to any disclaimer, the term of this patent is extended or adjusted under 35 U.S.C. 154(b) by 372 days.

(21) Appl. No.: 12/223,877

(22) PCT Filed: Aug. 30, 2006

(86) PCT No.: PCT/EP2006/008475

§ 371 (c)(1),
(2), (4) Date: Aug. 12, 2008

(87) PCT Pub. No.: WO2007/098791

PCT Pub. Date: Sep. 7, 2007

(65) Prior Publication Data

US 2010/0227496 A1 Sep. 9, 2010

(30) Foreign Application Priority Data

Mar. 2, 2006 (DE) ..... 10 2006 010 279

(51) Int. Cl.
*H01R 12/00* (2006.01)

(52) U.S. Cl. ..... 439/76.1; 439/404; 439/607.46; 439/607.47

(58) Field of Classification Search ..... 439/76.1, 439/676, 404, 418, 607.41–607.48
See application file for complete search history.

(56) References Cited

U.S. PATENT DOCUMENTS 4,516,822 A * 5/1985 Wolfel ..... 439/468
5,905,637 A * 5/1999 Su ..... 361/752
6,641,443 B1 * 11/2003 Itano et al. ..... 439/676
6,780,035 B2 * 8/2004 Bohbot ..... 439/188
6,786,776 B2 * 9/2004 Itano et al. ..... 439/676
7,314,393 B2 * 1/2008 Hashim ..... 439/676
7,488,529 B2 * 2/2009 Watanabe et al. ..... 428/317.9
2006/0014410 A1 * 1/2006 Caveney ..... 439/188
2007/0254529 A1 * 11/2007 Pepe et al. ..... 439/676
2009/0124137 A1 * 5/2009 Peng ..... 439/676
2009/0142968 A1 * 6/2009 Goodrich et al. ..... 439/676

FOREIGN PATENT DOCUMENTS

WO WO 02/15340 * 2/2002

* cited by examiner

*Primary Examiner*—Neil Abrams
*Assistant Examiner*—Phuong Nguyen
(74) *Attorney, Agent, or Firm*—The Nath Law Group; Jerald L. Meyer; Robert T. Burns

(57) ABSTRACT

Disclosed is a plug for shielded data cables, in particular an RJ45 plug, having an electrically conducting housing, which can be assembled from a first shell and a second shell. An electrically insulating plug body accommodates plug contacts. A printed circuit board, which can be inserted into the housing, bears the plug contacts and insulation displacement contacts and conductively connects them to one another. The printed circuit board is insulated from the housing by a non-conducting foil. The wires of the data cable to be connected can be inserted into a loading piece, wherein the wires are accommodated in two planes one above the other in the loading piece. The data cable can be mounted in the loading piece and the second shell. When the shells are assembled, the insulation displacement contacts make contact with the wires of the data cable which are accommodated in the loading piece.

13 Claims, 4 Drawing Sheets

PLUG FOR SHIELDED DATA CABLES

Figure 1:
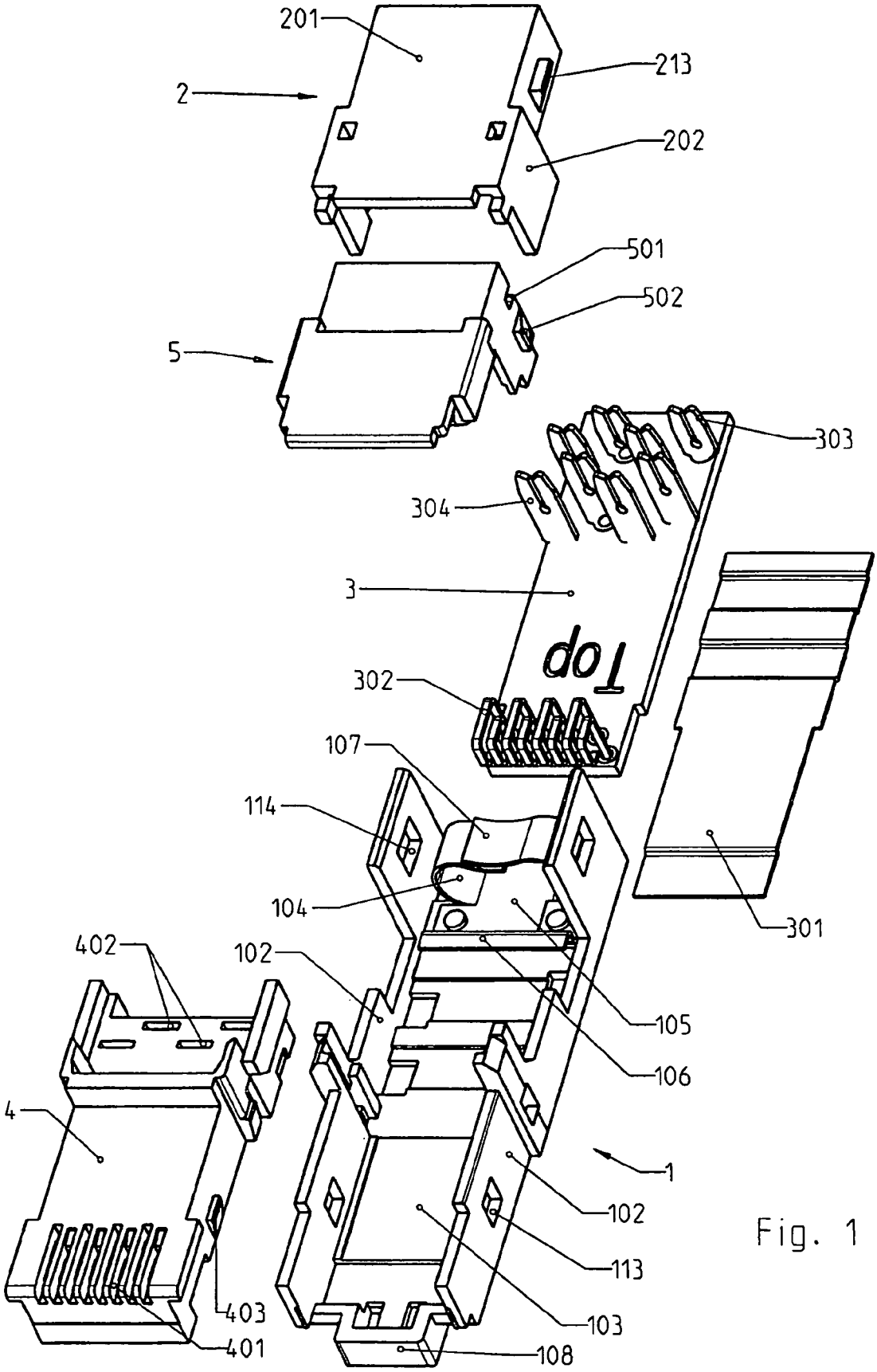

The invention relates to a plug for shielded data cables as per the preamble of claim 1.

Shielded data cables, which are connected by ready-made connectors, are the primary cables used for structured, non-dedicated cabling in an industrial and office environment. The connectors establish the conducting connection between the wires of the data cable and ensure shielding of the contacts. The shielding of the connectors then also serves to connect the shielding of the data cables that are to be connected to one another. These kinds of connectors are in particular used as RJ connectors.

A plug for shielded data cables of the aforesaid type is known from WO 02/15340 A1. A printed circuit board, which has insulation displacement contacts (IDC contacts) on one side for making contact with the wires of the data cable that is to be connected and plug contacts for the connector on the other side and connects them together, is inserted into an electrically conducting housing. The wires that are to be connected are fed into a loading piece, which is mounted on the insulation displacement contacts so as to make contact with the wires. A plug body, which is plugged into the socket of the connector, carries the plug contacts. The housing consists of two shells, which are connected via a joint and can fold into each other. After the shells are folded together, the ends of the shells opposite the joint form a strain-relief enclosing the data cable. Only four insulation displacement contacts are arranged in a row next to one another so that only one four-wire data cable can be connected. A separate die-bent sheet metal part is provided in the plug for transferring the shielding from the data cable to the receptacle.

U.S. Pat. No. 5,905,637 discloses a plug for shielded data cables wherein the insulation displacement contacts for the wires of the data cable that is to be connected and the plug contacts are respectively arranged in separate blocks, which are mounted on the printed circuit board connecting the contacts. The insulation displacement contacts are arranged in two rows of four insulation displacement contacts each, the rows being offset from one another in the insertion direction, so that eight wires, e.g. of an RJ45 plug, can be connected. The data cable is introduced between these two rows from above so that four wires can be inserted into the insulation displacement contacts toward the front and four wires oppositely toward the rear. The introduction of the cable into the top of the plug increases its overall height.

DE 100 57 833 A1 discloses a connector for shielded data cables in which eight wires of a data cable, e.g. an RJ45 connector, are taken up in a loading piece in two planes that are offset one above the other, and are inserted by means of the loading piece into insulation displacement contacts, which are arranged in two rows that are mutually offset in the insertion direction. A shielding sheet, which shields the contacts and transfers the shielding of the data cables that are to be connected to each other, is also inserted into the electrically conducting housing.

The object of the invention is to create a plug for shielded data cables, which is compact and easy to assemble.

This object is accomplished according to the invention by a plug having the features of claim 1.

Advantageous embodiments of the invention are specified in the dependent claims.

The plug according to the invention comprises an electrically conducting housing, which consists of two shells and includes a plug body, a printed circuit board and a loading piece. The plug body consists of an insulating material and carries the plug contacts, which establish the connector contacts when the plug body is plugged into a receptacle. The printed circuit board carries plug contacts on one side and insulation displacement contacts on the other side and connects these contacts. The wires of the data cable that is to be connected are fed into the loading piece, and the insulation displacement contacts make contact with them when the loading piece is mounted on the insulation displacement contacts. The insulation displacement contacts are arranged in two rows, which consist of four insulation displacement contacts each and are mutually offset in the insertion direction. The wires are arranged in two planes within the loading piece, one plane being located above the other plane so that the two rows of insulation displacement contacts make contact with the wires that are introduced into the two planes. This makes it possible to connect not only four-wire industrial cables, but also up to eight-wire standard office cables.

To make the overall height of the plug particularly small, a thin foil insulates the printed circuit board from the shell of the housing. Moreover, the insulation displacement contacts of the two mutually offset rows are configured at different heights. The front row (as seen from the insertion direction) of insulation displacement contacts is higher than the rear row. The plug body surrounds the area of the plug contacts of the front row located near the printed circuit board in order to mechanically stabilize the insulation displacement contacts. The rear row (as seen from the insertion direction) of insulation displacement contacts, in contrast, is open up to the printed circuit board so that, in the area of this rear row of insulation displacement contacts, the loading piece can be mounted up to the printed circuit board.

The plug can be readily assembled without expensive tools or devices. The wires of the cable that is to be connected are inserted into the loading piece where they emerge from the face of the loading piece pointing in the insertion direction. The wires can be cut off at this face. It is therefore unnecessary to adjust the length of the open end of the wires during assembly. To this end, a strain-relief can already clamp the cable that is to be connected within the shell of the housing containing the loading piece so that the wires are fixed in the loading piece and cannot be further displaced during assembly. The shell of the housing containing the loading piece must only be attached to the other shell of the housing, this other shell containing the printed circuit board with the insulation displacement contacts.

A resilient shielding contact, which is conductively connected to the housing, is inserted into one shell, preferably the shell of the housing containing the printed circuit board. When the shells are joined together, the data cable secured in the one shell by the strain-relief presses against the shielding contact attached in the other shell so that the shielding of the data cable unavoidably makes contact with the conducting housing when the shells are joined together for purposes of assembly. This therefore ensures a reliable connection of the shielding housing to the shielding of the cable and a transfer of the shielding to the socket accommodating the plug without additional actions.

Snap-in connectors lock the plug body, the loading piece and the shells of the housing together during assembly so that no additional devices, such as threaded joints or the like, are necessary.

The conducting housing and the contacting of the shielding of the connected data cable by the housing ensure all-around shielding of the open wire ends within the plug. The small dimensions of the conducting paths on the printed circuit board between the insulation displacement contacts and the plug contacts permit optimum conductor routing so that cross-talk between the individual wires is minimal. A signal transmission of at least 250 MHz is thus possible in connection with the shielding. Because of its small external dimensions, the plug can be installed into a great variety of standardized protective housings that are used in industrial applications, e.g. in order to satisfy the IP 67 protection requirements.

The small dimensions also make the plug particularly suitable for multiport sockets in which a plurality of sockets is arranged in a two-dimensional array.

Figure 2:
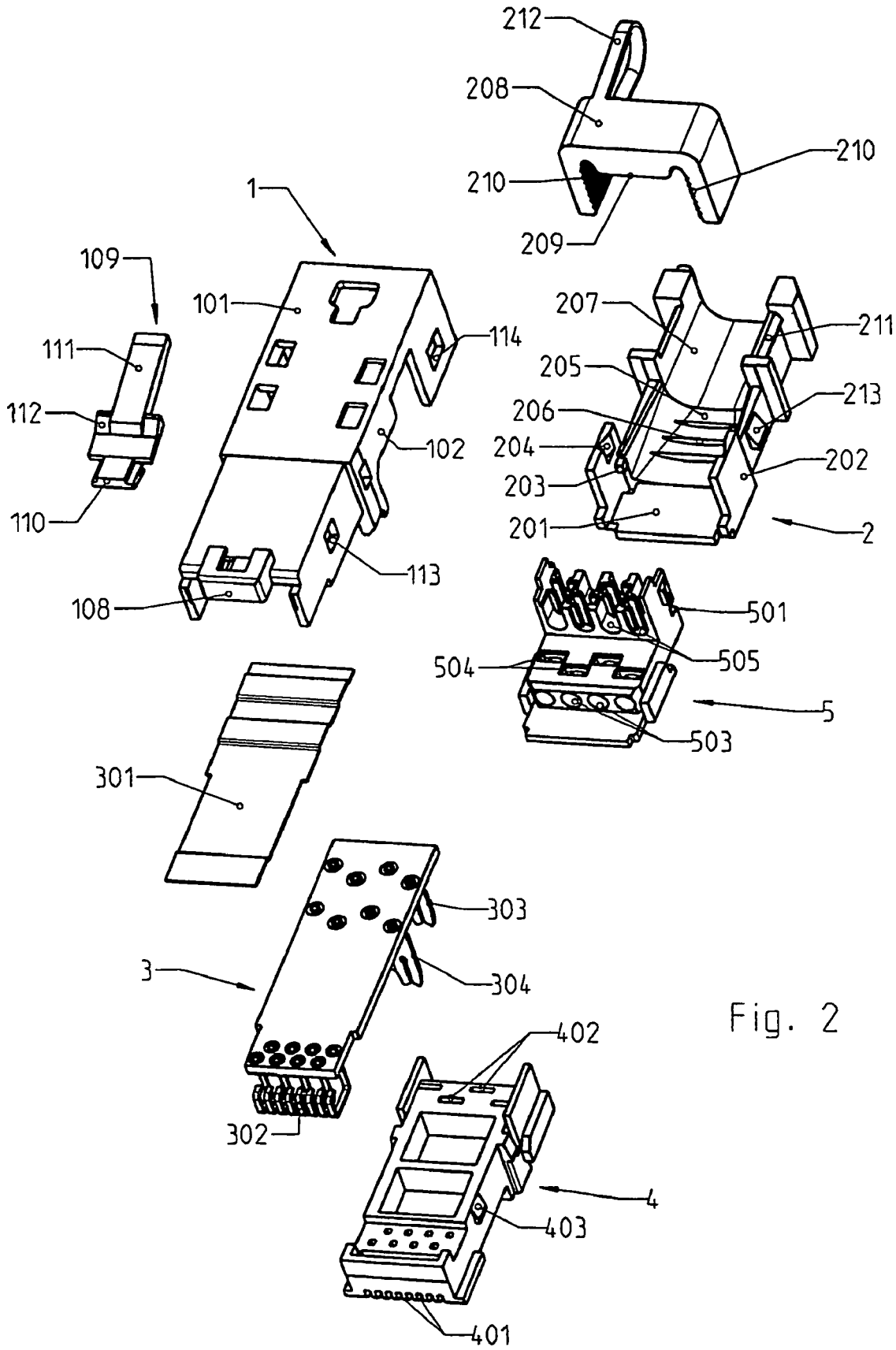
Figure 4:
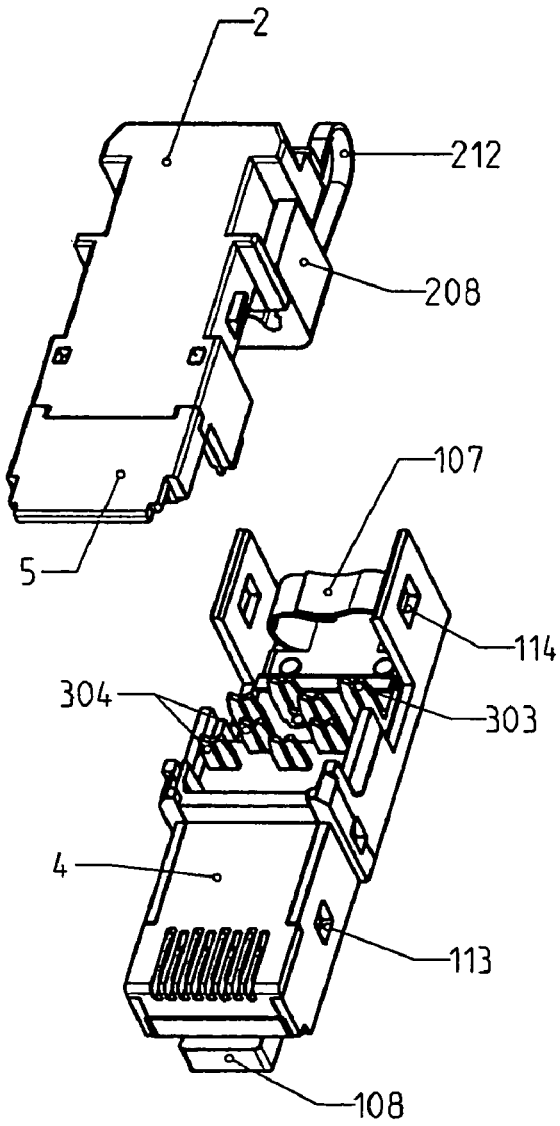
Figure 3:
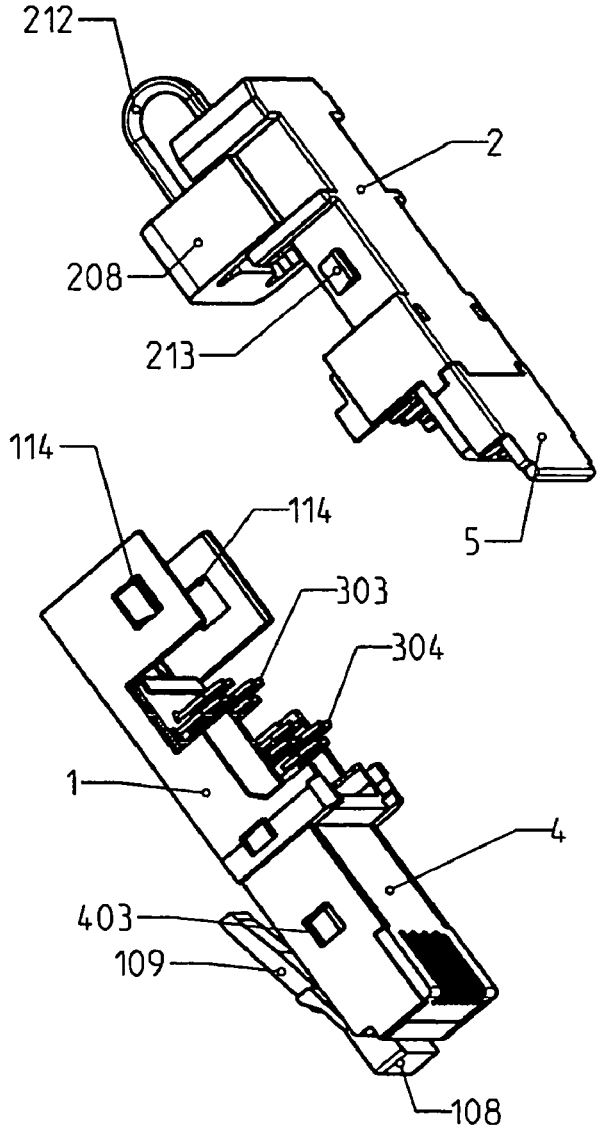

The invention will be explained in greater detail below based on the example embodiments presented in the drawing. The drawing shows:

FIG. 1 an exploded top view of the plug,

FIG. 2 and exploded view of the plug from below,

FIG. 3 a view of the plug before the housing is snapped together,

FIG. 4 a representation of the plug before assembly in another view, and

Figure 5:
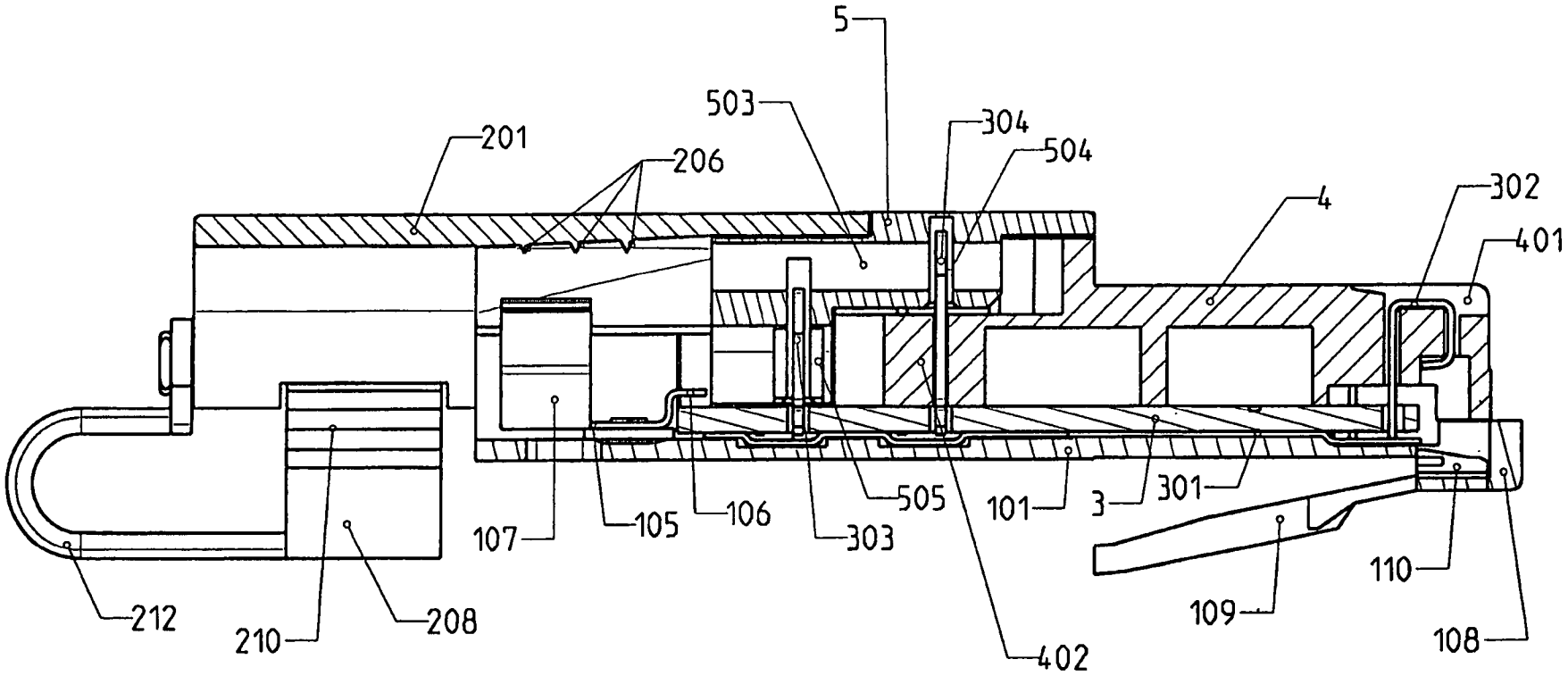

FIG. 5 a longitudinal section through the plug.

The plug has a housing, which is snapped together from a first shell 1 and a second shell 2. A printed circuit board 3, a plug body 4 and a loading piece 5 are inserted in the housing. The shells 1 and 2 of the housing are electrically conducting and are preferably configured as metal diecast parts, especially zinc diecast parts. The plug body 4 and the loading piece 5 consist of an insulating material and are in particular injection molded plastic parts.

The first shell 1 has the shape of a trough, which extends lengthwise in the insertion direction of the plug and has a rectangular U-shaped profile, which has a base 101 and side walls 102. In the part of the first shell pointing in the insertion direction of the plug (downward in FIG. 1), the base 101 has a recess 103 into which the printed circuit board 3 is inserted. On the rear end (as seen from the insertion direction), a shielding contact 104 is attached to the base 101. The shielding contact 104 is a metal stamping, which has a bottom surface 105 resting on the base 101 of shell 1 and which is conductively connected, e.g. riveted, thereto. The front edge 106 of the bottom surface 105 pointing in the insertion direction is bent at a right angle so that a gap, which can hold the rear edge of the printed circuit board 3 in order to position said printed circuit board in the shell 1, is formed between the front edge 106 and the base 101. Contact springs 107 are bent upward on the two longitudinal edges of the bottom surface 105 and bent inwards parallel to the bottom surface 105 so that the contact springs 107 and their overlapping open ends form an elastically resilient support.

A box-shaped attachment 108, which is open on the underside of the base 101 in the insertion direction, is formed onto the front edge of the base 101 of the shell 1 pointing in the insertion direction. A detent lever 109 can be suspended in the attachment 108. The front end of the detent lever 109 has a projection 110 with which it engages the front edge of the base 101 within the attachment 108 so that the detent lever 109 can be held in the attachment 108 in a retrofitable and releasable manner. A lever arm 111 of the detent lever 109 projects rearwards out the attachment 108. Detent shoulders 112, which serve to releasably anchor the plug into a socket (not shown), are formed onto the lever arm 111. If the lever arm 111 is pressed against the base 101 in a spring-like manner, the detent shoulders 112 can be released from the detent mechanism in the socket.

Plug contacts 302 are located on the front edge of the printed circuit board 3 pointing in the insertion direction. In the pictured example embodiment of an RJ45 plug, these are eight plug contacts 302 arranged next to one another. The plug contacts 302 are configured as brackets formed by wires or stampings. Insulation displacement contacts 303 and 304 are located on the rear edge of the printed circuit board 3 (as seen from the insertion direction). The insulation displacement contacts 303 and 304 are arranged in two rows, which extend perpendicular to the insertion direction and are offset from one another in the insertion direction. A rear row of insulation displacement contacts 303 adjoining the rear edge of the printed circuit board 3 has a lower height than the front row (with respect to the insertion direction) of insulation displacement contacts 304. Each row of insulation displacement contacts 303 and 304 consists of four insulation displacement contacts 303 and 304, which are offset for clearance and stand vertically upward from the printed circuit board 3.

The plug body 4 essentially has the shape of a rectangular parallelepiped whose cross-section corresponds to the inside cross-section of the first shell 1. On its front edge the plug body 4 has adjacent pass-through slots 401 pointing in the insertion direction. In its rear end region, the plug body 4 has four transverse slots 402 that pass through vertically. The plug body 4 is positioned on the printed circuit board so that its front edge pointing in the insertion direction coincides with the front edge of the printed circuit board 3. The rear end (in the insertion direction) of the plug body 4 extends past the front row of insulation displacement contacts 304.

The plug contacts 302 are inserted into the printed circuit board 3 through the slots 401. The insulation displacement contacts 304 of the front row are inserted into the printed circuit board through the transverse slots 402. The insulation displacement contacts 303 of the back row are also inserted into the printed circuit board 3. The printed circuit board 3 assembled in this manner is preferably soldered by means of the THR (through hole reflow) process. The tracks of the printed circuit board 3 thereby conductively connect the insulation displacement contacts 303 and 304 to the plug contacts 302. The printed circuit board 3 with the insulation displacement contacts 303 and 304 and the plug contacts 302 thus forms a compact subassembly along with the plug body 4. The plug contacts 302 lie open in the slots 401 on the front edge and the top of the plug body so that they can make contact with the corresponding contacts of the socket when the plug is plugged into a socket. The insulation displacement contacts 304 of the front row penetrate through the transverse slots 402 and project upwards above the top of the plug body 4. The insulation displacement contacts 303 of the rear row stand open on the rear edge of the printed circuit board 3 behind the plug body 4.

A thin insulating foil 301 is inserted into the recess 103 of the first shell 1. The dimensions of the foil 301 correspond to those of printed circuit board 3. After the insertion of the foil 301, the subassembly formed by the printed circuit board 3 and the plug body 4 is inserted into the first shell 1. The plug body 4 has at least one detent 403 on each of its two longitudinal side surfaces. These detents 403 snap into snap-in recesses 113 in the side walls 102 of the first shell 1 when this subassembly is pressed into shell 1. This secures the plug body 4 and the printed circuit board 3 into the first shell 1. The foil 301 completely electrically insulates the printed circuit board 3 and its tracks and solder points from the shell 1.

After the printed circuit board 3 has been inserted and locked into the plug body 4, the shielding contact 104 is inserted into the shell 1 behind the printed circuit board 3 and is connected to the shell 1, e.g. by rivets. The front edge 106 of the shielding contact 104 then engages the rear edge of the printed circuit board 3, holding it in place within shell 1 as well.

The second shell 2 likewise essentially has the shape of a rectangular U-profile, which extends in the insertion direction and has a top surface 201 and side walls 202. The loading piece 5 is inserted into the front end of the second shell 2, which points in the insertion direction. To this end, the loading piece 5 has notches 501 on both rear outside edges, with which internal projections 203 on the side walls 202 engage when the loading piece 5 is pushed into the second shell 2. To maintain the engagement between the projections 203 and the notches 501, a detent 502 molded onto the top of the loading piece 5 locks into a detent recess 204 in the top surface 201 of the shell 2.

The loading piece 5 is designed to be staggered. In a top plane adjoining the top surface 201 of the shell 2, the loading piece 5 has four parallel bored holes 503 passing through in the insertion direction. Transverse slots 504, which are mutually offset for clearance and have an arrangement corresponding to that of the insulation displacement contacts 304 of the front row, extend from the bottom, into these bored holes 503. Four adjacently positioned receiving prongs 505, which are open toward the bottom, are formed onto the bottom of the loading piece 5 behind these transverse slots 504.

A shielding contact area 205 of shell 2 is located adjacent to the area of shell 2 that accommodates the loading piece 5. The inside top surface 201 of this shielding contact area 205 has contact ribs 206, which protrude inward and run perpendicular to the insertion direction. A strain-relief area 207 of the shell 2 is added adjacent to this shielding contact area 205. The inside of the top surface 201 of this strain-relief area 207 is configured as a trough. A strain-relief clamp 208 can be mounted on the strain-relief area 207. The strain-relief clamp 208 has the shape of a U-shaped bracket, which has inwardly-directed pressing edges 209 located on its center yoke. The inside of each of the two legs of the strain-relief clamp 208 has a toothed surface 210. The toothed surfaces 210 cooperate with the detent edges 211, which are formed on the outside of the side walls 202 of shell 2 in the strain-relief area 207. The strain relief clamp 208 is undetachably connected to the shell 2 by means of a latch 212.

To connect a data cable, especially an eight-wire cable, the wires at the end of the cable are laid bare. Adjacent to the bared wires, a section of the shielding of the cable is freed of its outer cable insulation. The wires are then fed into the loading piece 5, with four wires being fed into the bored holes 503 of the top plane and the other four wires are pressed into the receiving prongs 505 and are clamped therein. The bared shielding of the cable then comes to rest in the shielding contact area 205 of shell 2. The strain-relief clamp 208 is then put on and pressed against the shell 2. The pressing edges 209 of the strain-relief clamp 208 press the cable and its insulating jacket into the trough of the shell 2 so as to secure the cable in a strain-relieved manner. The toothed surfaces 201 enable the strain-relief clamp 208 to be locked into any desired position so that cables with different cross sections can be clamped and held in a strain-relieved manner. By means of this strain-relief, the cable is secured in the second shell 2 and the wires of the cable are held in the loading piece 5. The projecting ends of the wires can now be cut to length at the face of the bored holes 503 or of the receiving prongs 505 pointing in the insertion direction. The assembly of the cable in the loading piece 5 and the shell 2 is simple and can be performed independently of the remaining part of the plug. The second shell 2, with the loading piece 5 locked within it and the installed cable, is then put on the first shell 1 containing the printed circuit board 3 and the plug body 4. The loading piece 5 is mounted so that the front insulation displacement contacts 304, which project upwards from the plug body 4, penetrate through the transverse slot 504 into the bored holes 503, while the rear insulation displacement contacts 303 penetrate into the receiving prongs 505. The insulation displacement contacts 304 thereby make contact with the wires of the top plane of the bored holes 503, while the rear insulation displacement contacts 303 make contact with the wires pressed into the receiving prongs 505. To hold the first shell 1 and second shell 2 together in their assembled state, the detents 213 of the second shell 2, which are formed into the side walls 202 in the shielded contact area 205, lock into snap-in recesses 114 in the corresponding area of the side walls 102 of the first shell 1. With this assembly of shells 1 and 2, the contact springs 107 of the shielding contact 104 of the first shell 1 are positioned on the bared shielding of the cable and press this shielding against the contact ribs 206 of the second shell 2 in an elastically resilient manner. A reliable contact between the shielding of the cable and the two electrically conducting shells 1 and 2 of the plug housing is thereby established.

FIG. 1 shows the plug without the strain-relief, i.e. the strain-relief area 207 and the strain-relief clamp 208 are missing. This version is provided for installation into protective housings, which already have strain-relief.

LIST OF REFERENCE CHARACTERS

1 First shell
101 Base
102 Side walls
103 Recess
104 Shielding contact
105 Bottom surface
106 Front edge
107 Contact springs
108 Attachment
109 Detent lever
110 Detent
111 Lever arm
112 Detent shoulders
113 Snap-in recesses
114 Snap-in recesses
2 Second shell
201 Top surface
202 Side walls
203 Projections
204 Detent recesses
205 Shielding contact area
206 Contact ribs
207 Strain-relief area
208 Strain-relief clamp
209 Pressing edges
210 Toothed surfaces
211 Detent edges
212 Latch
213 Detents
3 Printed circuit board
301 Foil
302 Plug contacts
303 Rear insulation displacement contacts
304 Front insulation displacement contacts
4 Plug body
401 Slot
402 Transverse slot
403 Detents
5 Loading piece
501 Notches
502 Detents
503 Bored holes
504 Transverse slots
505 Receiving prongs.

The invention claimed is:

1. An RJ45 plug for shielded data cables with an electrically conducting housing, comprising:

a first shell (1) and a second shell (2), with an electrically insulating plug body (4), which accommodates plug contacts (302), with a printed circuit board (3), which can be inserted into the housing (1, 2) and which carries the plug contacts (302) and insulation displacement contacts (303, 304) and conductively connects them to one another, and with a loading piece (5) into which the wires of the data cable can be inserted and which can be mounted on the printed circuit board (3) to establish contact between the wires and the insulation displacement contacts (303, 304), characterized in that the printed circuit board (3) can be inserted into the first shell (1) and is electrically insulated against a base (101) of the first shell thereof by a foil (301), that the insulation displacement contacts (303, 304) are arranged in two rows that are mutually offset in the insertion direction of the plug, that the rear row of insulation displacement contacts (303) has a lower height than the front row of insulation displacement contacts (304), that the loading piece (5) accommodates the wires in two planes with the ends of the wires offset in a staggered manner, and that the wires of the plane that projects further out make contact with the insulation displacement contacts (304) of the front row.

2. The RJ45 plug according to claim 1, characterized in that the loading piece (5) has pass-through bored holes (503) for the wires in the top, projecting, stepped plane and has receiving prongs (505) for clamping the wires in the lower, set-back plane.

3. The RJ45 plug according to claim 1, characterized in that a detent lever (109) can be hooked into the shell (1) accommodating the plug body (4).

4. The RJ45 plug according to claim 1, in which there is a rear row having four insulation displacement contacts (303) and a front row with four insulation displacement contacts (304) and in which the loading piece (5) has a top projecting plane having four bored holes (503) and a set-back, lower plane having four receiving prongs (505).

5. The RJ45 plug according to claim 1, characterized in that a shielding contact (104) is attached in one of the shells (1, 2) so that it is conductingly connected with this shell and lies resiliently against the bared shielding of the installed data cable when the shells (1, 2) are assembled and presses this bared shielding against the respective other shell (2, 1).

6. The RJ45 plug according to claim 5, characterized in that the shielding contact (104) is a spring-steel-sheet stamping that is riveted into the shell (1,2).

7. The RJ45 plug according to claim 1, characterized in that the loading piece (5) can be inserted into the second shell (2) when the latter is separated from the first shell (1) and that the data cable can be installed into the loading piece (5) and the second shell (2).

8. The RJ45 plug according to claim 7, characterized in that a strain-relief (207, 208) secures the cable to the second shell (2).

9. The RJ45 plug according to claim 8, characterized in that the strain-relief has a locking strain-relief clamp (208) that can be adjusted relative to a strain-relief area (207) of the second shell (2).

10. The RJ45 plug according to claim 1, characterized in that the insulation displacement contacts (304) of the front row are surrounded by the plug body (4) in their area near the printed circuit board.

11. The RJ45 plug according to claim 10, characterized in that the insulation displacement contacts (303, 304) and/or the plug contacts (302) are soldered or pressed into the printed circuit board and are covered by the foil (301) on the opposite bottom side of the printed circuit board (3).

12. The RJ45 plug according to claim 11, characterized in that the insulation displacement contacts (303, 304) and/or the plug contacts (302) are connected to the printed circuit board (3) by means of the THR (through hole reflow) soldering process.

13. The RJ45 plug according to claim 11, characterized in that the pins of the insulation displacement contacts (303, 304) and/or plug contacts (302) do not project beyond the lower edge of the printed circuit board (3).

* * * * *